United States Patent [19]

Hoffman

[11] Patent Number: 4,603,516

[45] Date of Patent: Aug. 5, 1986

[54] SELF PROPELLED PIPE BLAST CLEANER CAPABLE OF TRAVEL ALONG A PIPELINE SUPPORTED OVER THE DITCH

[75] Inventor: Joseph H. Hoffman, Plano, Tex.

[73] Assignee: Resource Engineering and Manufacturing Corp., Tulsa, Okla.

[21] Appl. No.: 595,661

[22] Filed: Apr. 2, 1984

[51] Int. Cl.[4] ..... B24C 3/06

[52] U.S. Cl. ..... 51/425; 51/429; 51/411

[58] Field of Search ..... 51/411, 424, 425, 420, 51/426, 429

[56] References Cited

U.S. PATENT DOCUMENTS

| | | | |
|---|---|---|---|
| 1,941,002 | 12/1933 | Harrison | 51/420 |
| 2,131,770 | 10/1938 | Turnbull | 51/426 |
| 2,460,989 | 2/1949 | Kraner | 51/411 |
| 2,621,446 | 12/1952 | Russell | 51/420 |
| 3,127,706 | 4/1964 | Giffen | 51/411 |
| 3,362,109 | 1/1968 | Wallace | 51/411 |

*Primary Examiner*—Frederick R. Schmidt

*Assistant Examiner*—Robert A. Rose

*Attorney, Agent, or Firm*—William S. Dorman

[57] ABSTRACT

A self propelled airless grit blast machine that travels on and along a pipeline pipe as it continuously blast cleans the outside of the pipe in advance of pipe coating and/or wrapping. The airless grit blast machine is mounted on a carriage having rollers some of which are driven for controlled driven advance along the pipe being shot grit blast cleaned. A shot grit blast cabinet with a plurality of motor driven airless blast wheels surrounds the pipe being grit blast cleaned in substantially a self contained unit also including a grit elevator system, air wash separator system, shot grit storage hopper, abrasive shot grit retaining seals, abrasive flow controls, and an operator platform with a control panel. An umbilical cord extends to the machine from auxillary equipment including a power generator and dust collector located on a tracked vehicle or on an equipment sled pulled behind a side boom equipped tractor used to walk pipe and hold the pipe in an elevated state as the pipe is being worked along the pipeline right of way.

20 Claims, 9 Drawing Figures

Figure 1:
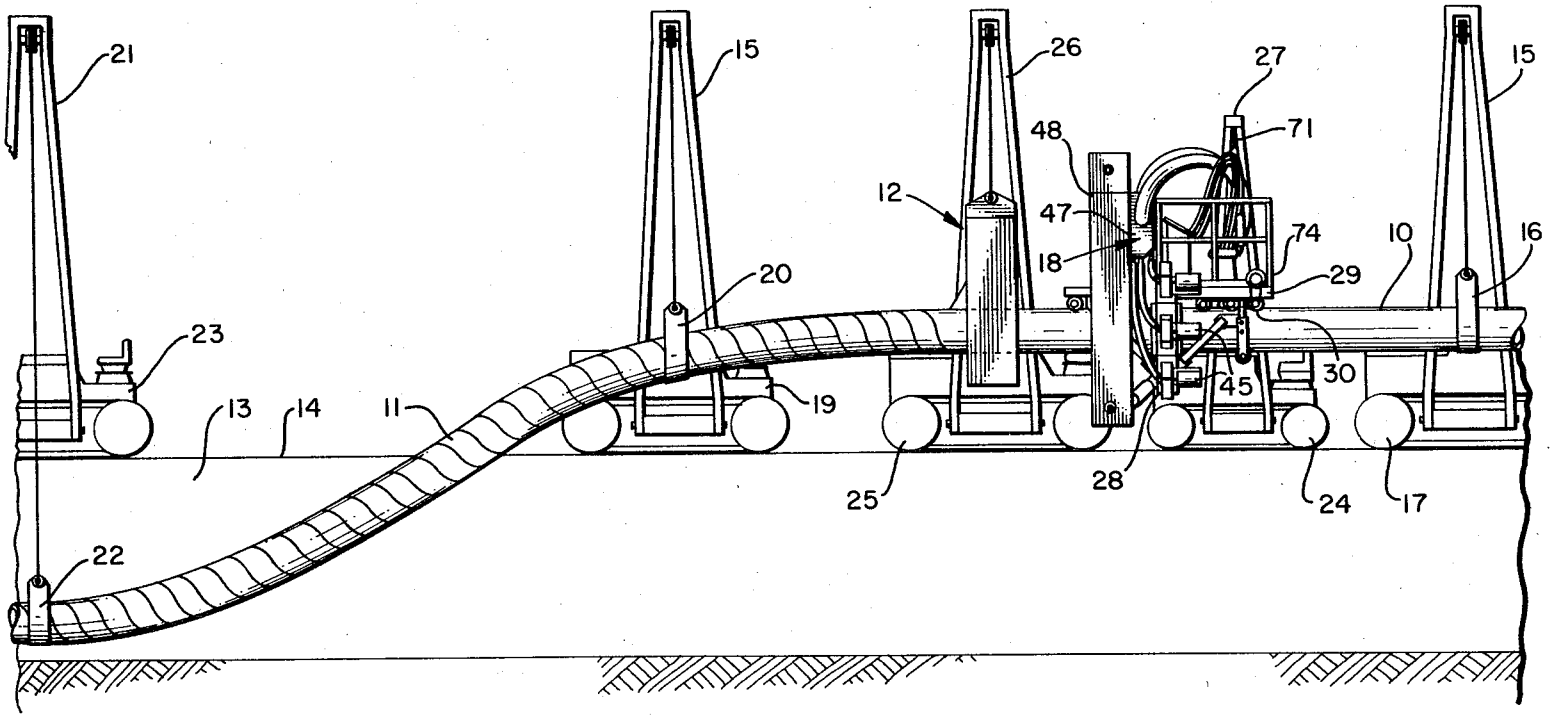

SELF PROPELLED PIPE BLAST CLEANER CAPABLE OF TRAVEL ALONG A PIPELINE SUPPORTED OVER THE DITCH

This invention relates in general to abrasive shot grit pipe cleaning preparatory to pipe coating and/or wrapping for being positioned in place along the pipeline right of way generally buried in a trench and sometimes above ground over tundra, across streams and rivers, and more particularly, to a self propelled over the ditch pipe blast cleaner that travels on the pipe as it continuously blast cleans the outside of the pipe in advance of pipe coating and/or wrapping along the pipeline right of way with the pipe therebehind worked into the pipe trench advancing across the ground.

From the onset of long distance large diameter piping there has been an ongoing need for continuously advancing cleaning of the outside surface of such pipes over the ditch just in advance of pipe coating and/or wrapping for pipe lowered placement in the ground. Since, heretofore, a machine capable of efficient operation in accomplishing such a task has been non existent the pipe coating industry has gone to permanent and semi-permanent pipe coating facilities scattered at various locations in many areas of the world. Raw pipe is hauled to such facilities, unloaded, stored, cleaned, coated, again stored, and then ultimately shipped to final destinations. Once there it is off loaded along the right of way, positioned, welded, racked, seam coated, inspected, repaired as required much too often, and then buried upon acceptable inspection. This process, while quite awkward and expensive, has been used heretofore as the lesser of all evils. The many problems encountered that must be faced on each job worked in the old traditional way include extremely high handling of materials costs with many extra handling steps required, and with, after coating, the hazard of coating damage with each extra pipe handling step. This contributes to added corrective repair costs and delays to burying the pipeline. With on site pipe section to pipe section welding of the pipe line all weld seams must be cleaned and coated after welding over the ditch joining previously applied coated and/or wrapped sections of the pipe. In an alternate approach rotary wire brushing and scraping is used over the ditch but this achieves only minimally acceptable cleaning of the pipe in that mostly loose rust and scale is removed along with dirt to attain a polishing effect.

In an attempt to overcome at least some of the problems another pipe cleaning system was tried in a cleaning machine that was carried down the pipeline right of way from a Catapillar tractor side boom in an approach that, unfortunately, was entirely too heavy and cumbersome. Factors contributing to its failure are that its overall weight was unmanageable and with the terrain of land being irregular, the right of way not being smooth enough for the carrying of precision machinery. This contributed to excessive machinery down time and an excessive slow rate of machine rate of travel simply not acceptable in meeting project work schedules.

It is therefore a principal object of this invention to provide a self propelled pipe blast cleaning machine light enough to be supported by the pipe through an advancing work elevated portion of the pipeline.

Another object is to minimize handling of pipe sections prior to welded assembly into a continuous pipe with pipe sections transportable directly from manufacturing site or shipping port of entry to the pipeline right of way.

A further object is to eliminate a pre-existing requirement for masking pipe section ends.

Still another obejct is to minimize damage to pipe coating during work handling.

Another object is to eliminate the requirement for special specific cleaning and coating of each pipeline weld joint seam.

A further object is increased efficiency of pipeline coating and laying in the ditch with minimized damage, simplified inspection requirements, and lowered costs.

Still another object is to provide a blast cleaned outer pipe surface most accepted for all pipe coatings and wrappings used.

Features of the invention useful in accomplishing the above objects include, in a self propelled pipe blast cleaner capable of travel along a pipe line in the advancing work portion of the pipeline held in an elevated state over the ditch, a self propelled shot and/or grit blast machine using the pipeline as its highway. The overall weight of the machine is sufficiently reduced that pipeline pipe is sufficiently strong to support the machine in the span between advancing heavy equipment slings holding an advancing portion of the pipeline in an elevated cleaning and coating and/or wrapping over the ditch and working to the ditch processing state. The machine carries a work platform with infinitely variable drive speed control and has a removable drop-out bottom section for ease of machine removal from the pipeline. It is a self contained machine including airless blast wheels, blast cabinet, elevator system, air wash separator system, storage hopper, shot and/or abrasive shielding and flow controls, and a control panel on the work station platform. Auxillary equipment including a power generator, fuel supply and dust collector are located on a sled pulled behind a side boom Catapillar used to work elevate and walk the pipe down the right of way, or on a wheeled wagon or self-propelled tracked vehicle provided therefore. The machine is designed for self drive up and down 15° inclines and for advancing through standard A. P. I. bends in the pipeline. It is available in various sizes for blast cleaning pipe diameters ranging from 4" through 48" and even larger with the center of gravity of the machine well below the pipe longitudinal center line to enhance safe machine stability in self propelled work blast cleaning advance along the pipe.

A specific embodiment representing what is presently regarded as the best mode of carrying out the invention is illustrated in the accompanying drawings.

Figure 2:
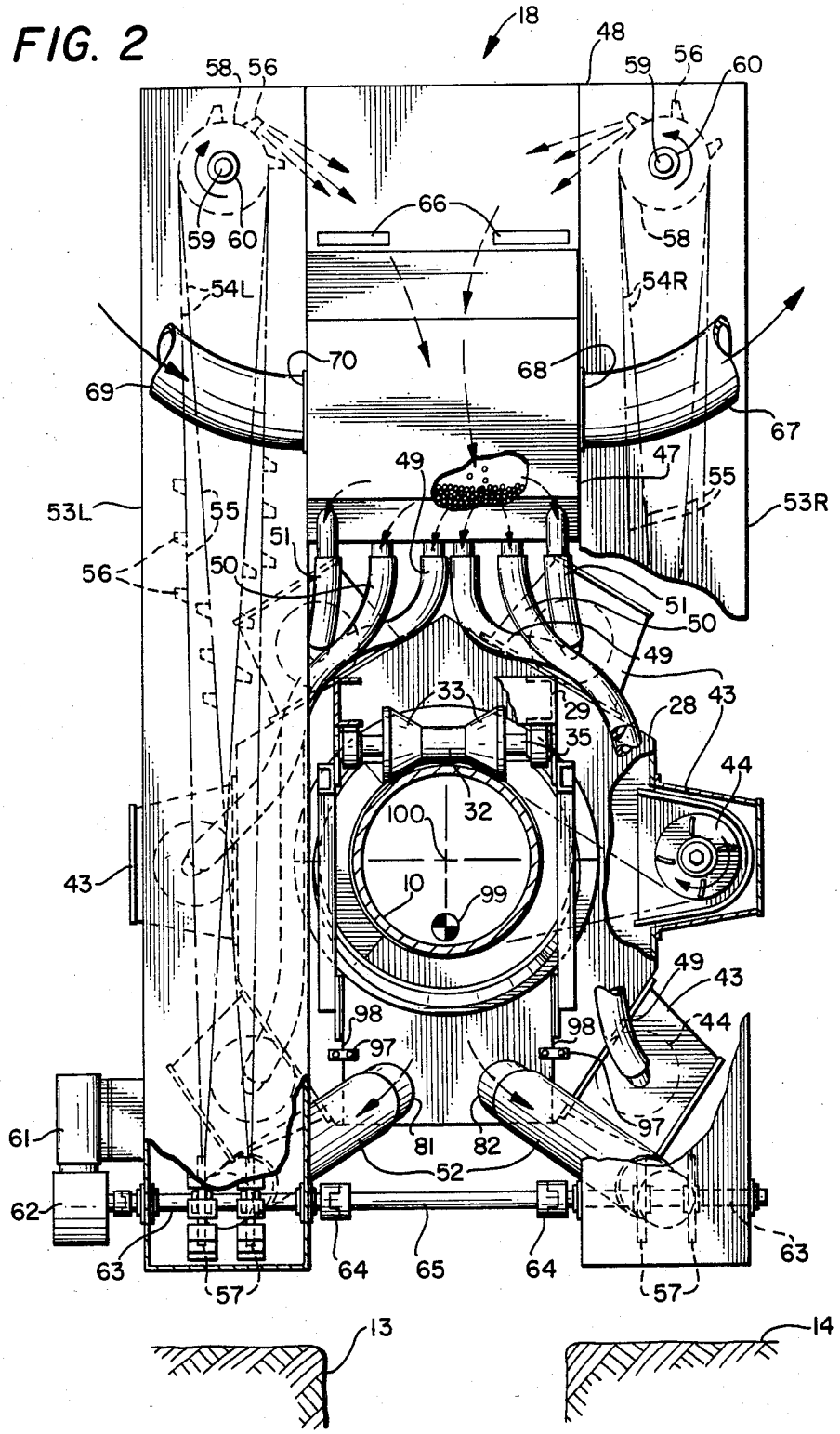
Figure 3:
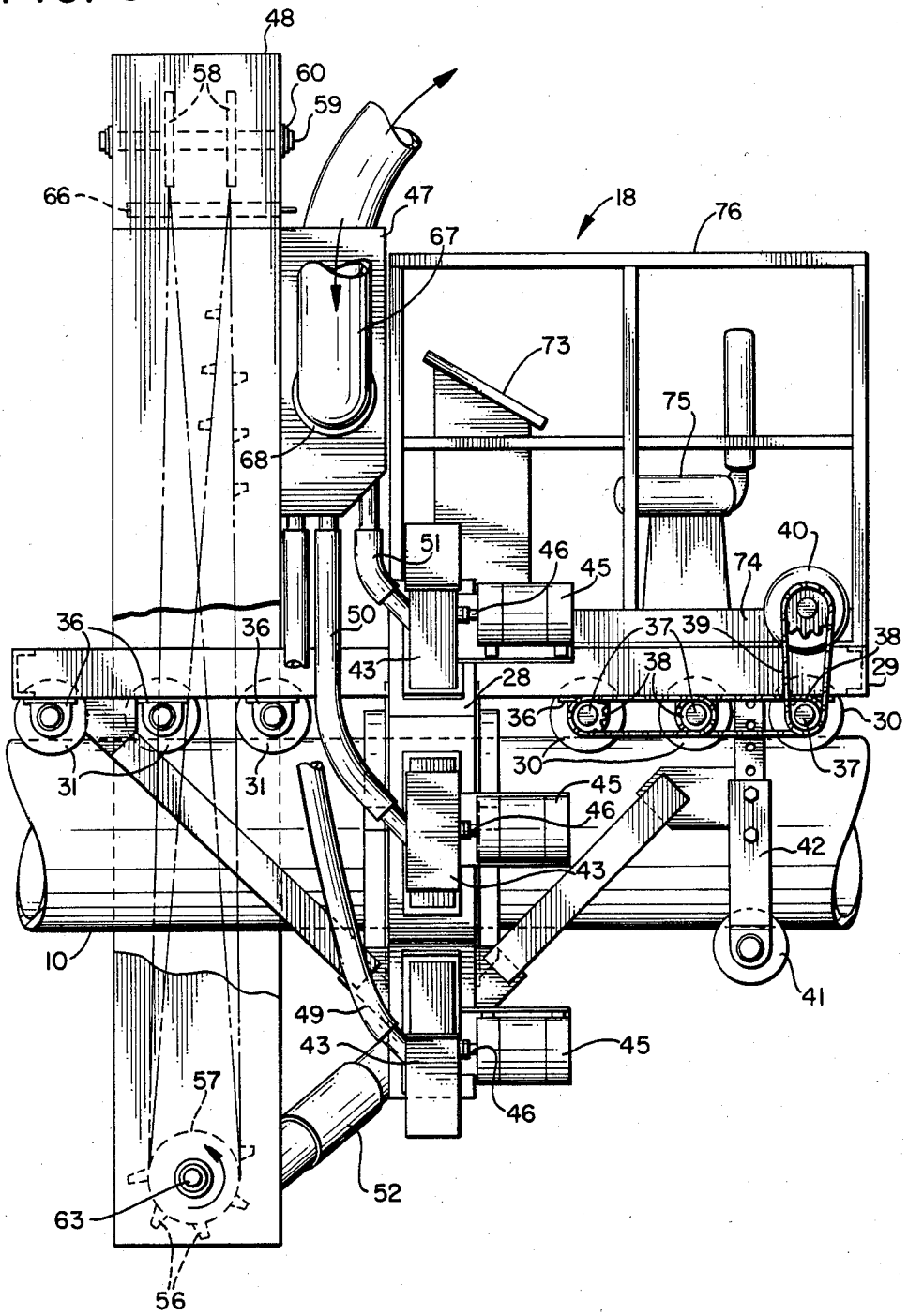
Figures 4, 5:
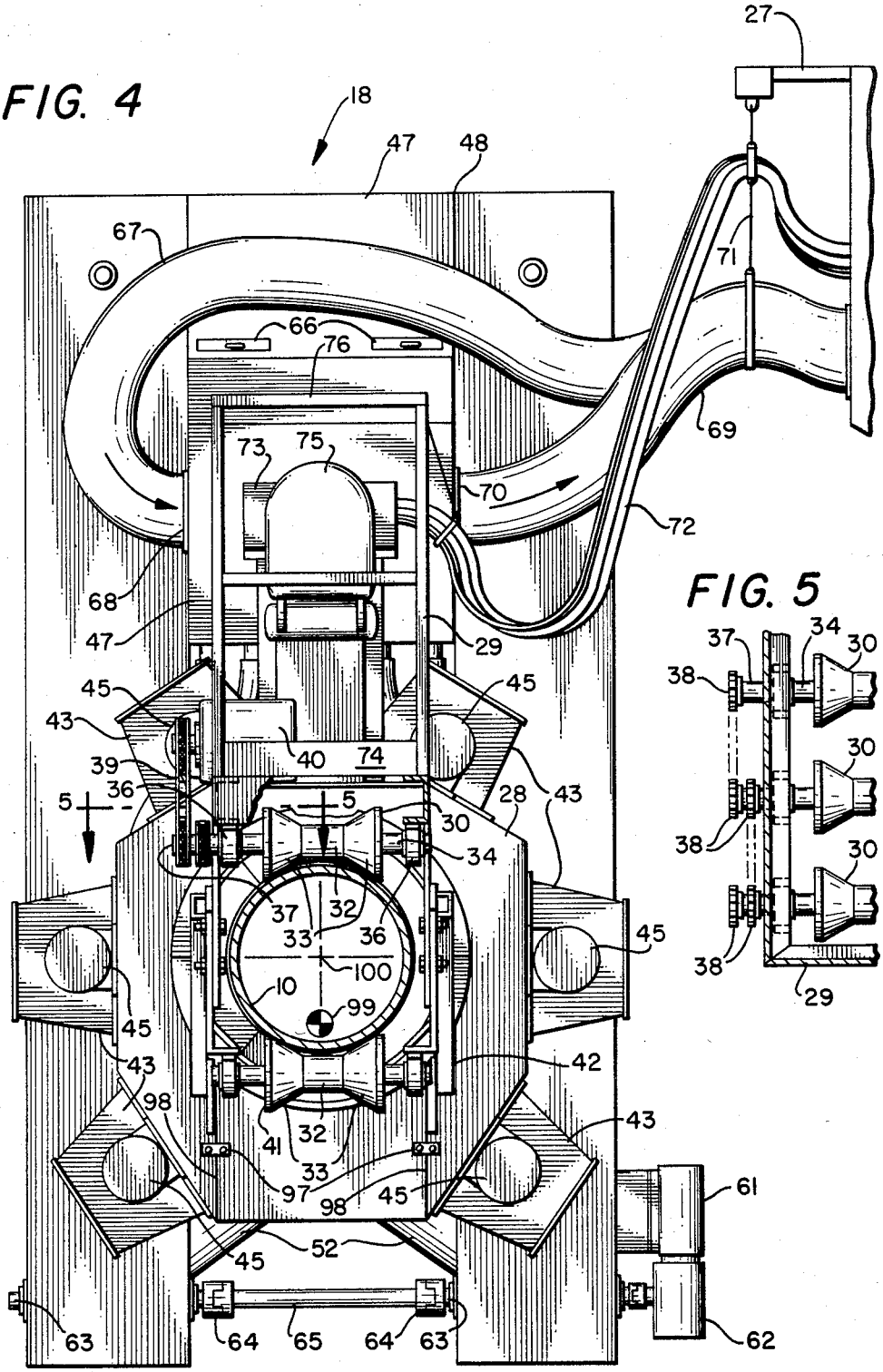
Figure 6:
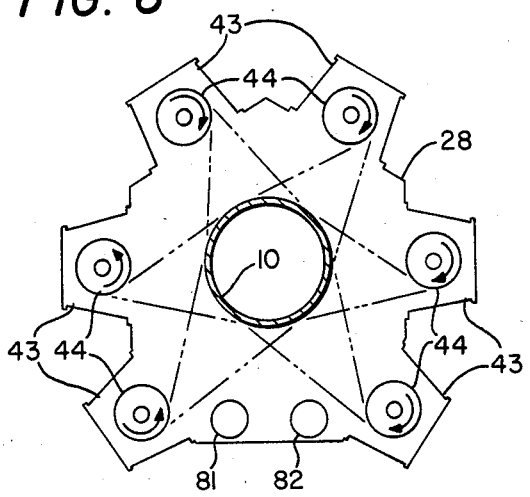
Figure 7:
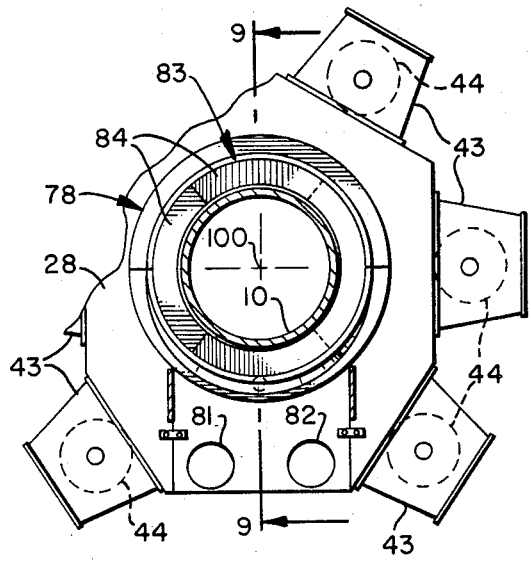
Figure 8:
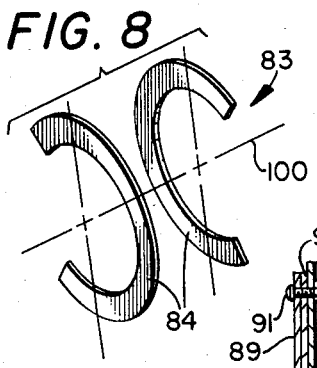
Figure 9:
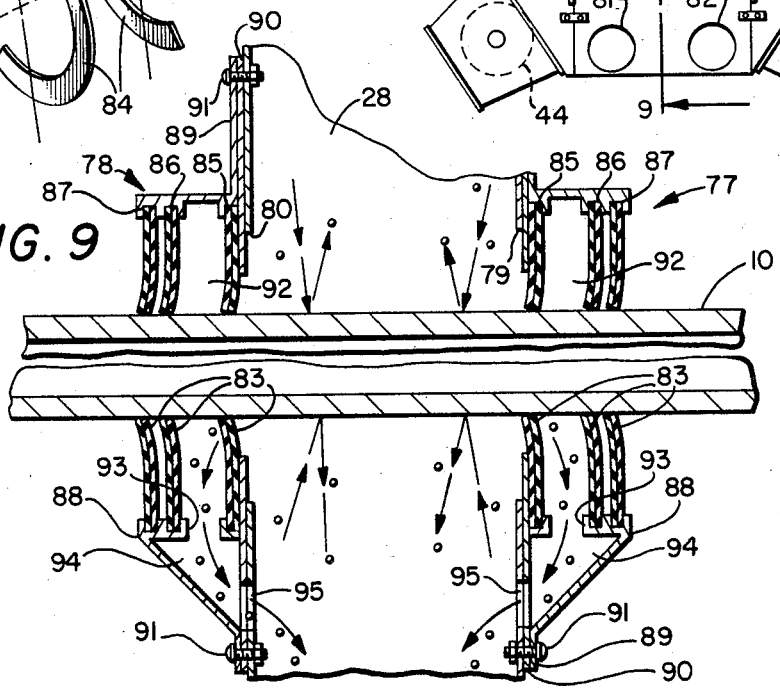

In the drawings:

FIG. 1 represents a side elevation view of a section of pipeline being work processed through an elevated portion as held by advancing boom slings extended from track vehicles with the pipe surface blast cleaning machine and a coating wrap machine and with the pipe walked into the trench;

FIG. 2, a partially broken away and sectioned back elevation view of the pipe blast cleaner on a pipe;

FIG. 3, a side elevation view of the pipe blast cleaner on a pipe;

FIG. 4, a front elevation view of the pipe blast cleaner on a pipe;

FIG. 5, a partial broken away top plan view showing driver roller drive detail;

FIG. 6, a partial back elevation view of the blast cabinet enclosing a plurality of airless blast wheels with the shot throw patterns;

FIG. 7, a partial back elevation view of the back of the blast cabinet;

FIG. 8, a perspective view of two seal sections that together form one of the six seal assemblies shown in FIG. 9; and FIG. 9, a cut away and sectioned view taken along line 9—9 of FIG. 7 showing blast cabinet and seal to pipe detail;

Referring to the drawings

The pipeline pipe 10 that is shown being work processed along the pipeline right of way and in the final wrap coated state 11 extending back from the wrap coating machine 12 is walk process deposited in right of way trench 13. The pipe 10 that was laying on the ground surface 14 near the right of way trench 13 is lifted by and held in an elevated state by a side boom 15 with a sling 16 mounted on a self propelled track equipped vehicle 17 in advance of the blast pipe cleaning machine 18 followed by the coating and/or wrap coating machine 12. Thereafter a tractor 19 having a side boom 15 with a sling 20 helps hold a continuously advancing work portion of the pipe 10 in the elevated state and also guides the cleaned and wrapped pipe 11 to the bottom of the trench 13 as also guided by the boom 21 and sling 22 of tractor 23. All the vehicles shown in FIG. 1 travel from left to right in advancing the elevated work portion of pipe 10 along the pipeline right of way. This includes vehicle 24 that may be a self propelled tractor, a wheeled wagon or a sled pulled behind tractor 17, and tractor 25 with a side boom 26 carrying wrap coating machine 12.

The vehicle 24 carries auxillary equipment including a power generator, fuel supply tank, and a dust collector, and mounts a boom 27 supporting umbilical interconnections to the self propelled pipe blast cleaner 18 carried by and traveling along the pipe 10. This structure enables the pipe blast cleaner 18 to be of sufficiently reduced weight as to be safely supported by the pipe 10 in the advancing pipe work portion between slings 16 and 20.

Referring also to FIGS. 2, 3 and 4 the pipe blast cleaner 18 is shown in greater detail with a blast cabinet enclosure 28 that surrounds pipe 10 mounted on and carried by self propelled cart 29 that rolls along the pipe 10 on front driven rollers 30 and rear idler rollers 31. Rollers 30 and 31 each have a center cylindrical portion 32 and conical opposite ends 33 as an aid to guiding the pipe blast cleaner 18 in riding on pipe 10. The rollers 30 and 31 may be molded from rubber or rubber like material mounted on shafts 34 and 35 in turn rotatably mounted in bearing structures 36 on cart 29. Referring also to FIG. 5 the drive roller shafts 34 have extensions 37 for mounting sprockets 38 of chain and sprocket drive 39 from electric drive motor 40 mounted on cart 29. An additional roller 41, like rollers 30 and 31, is rotatably mounted in frame structure 42 to roll along the bottom of pipe 10 as an aid to holding the blast cleaner cart 29 on pipe 10 and rollers 30 in proper driving contact with pipe 10 through all pipe turns. While rollers 30 are shown to be driven rollers, rollers 31 could be driven rollers and any of various combinations of rollers 30 and 31 could be driven rollers with the remaining rollers being idlers.

The blast cabinet enclosure 28 of the pipe blast cleaner 18 is shown to have six housing projections 43 for internally rotatably mounting an airless blast wheel 44 in each and to the exterior a drive motor 45 driving its airless blast wheel 44 through an interconnecting shaft 46. Referring also to FIG. 6 it should be noted that two of the airless blast wheels 44 are driven in the reverse direction from the other four wheels 44 for enhanced shot and/or grit throw patterns impinging on the outer surface of the pipe 10. A shot and/or grit resevoir cabinet 47 is mounted on a dual elevator structure 48 above and a little to the rear of the blast cabinet enclosure 28 in order that blast cleaning shot and/or grit may be readily fed therefrom through feed lines 49, 50 and 51 to respective airless blast wheels 44. Shot and/or grit thrown by the airless blast wheels 44 and impinging on pipe 10 to blast clean the outer surface thereof falls to the bottom of blast cabinet enclosure 28 from which it passes through two tubes 52 one each to the interior of the bottom of a vertical elevator housing 53L or 53R. Each of the elevators 54L and 54R, respectively, contained within elevator housings 53L and 53R are of the dual belt 55 with belt mount multiple cup 56 material handling elevators with the belts 55 twisted ninety degrees between dual driving pulleys (or sprockets) 57 for each elevator 54L and 54R and dual idler pulleys (or sprockets) 58 rotatably mounted by shafts 59 in bearings 60 at the top of each elevator. This twisted elevator belt 55 structure enables common drive of the belts 55 of both elevators 54L and 54R from drive motor 61, mounted to the left as related to the direction of machine travel, through a multi-section shaft drive train 62 with rotatably mounted elevator shafts 63 and a coupling 64 connected interconnect drive shaft 65. The twisted elevator belt 55 structure also directs discharge therefrom inwardly to the shot and/or grit resevoir cabinet 47 toward shot and/or grit condition sampling trays 66 that can be drawn to the exterior for inspection.

An air wash gravity type separator system is included in the upper portion of shot and/or grit resevoir cabinet 47 that includes removable trash screening for the removal of oversize and undersize contamination with sampling trays 66. Dust created during the blast cycle is passed to and through the elevator housings 53L and 53R from the blast cabinet enclosure 28 to the resevoir cabinet 47 with removal therefrom via air circulation from and to the dust collector system on vehicle 24. This includes air circulation handled through air inlet conduit 67 connected to resevoir cabinet opening 68 and suction air conduit 69 connected to resevoir cabinet opening 70 with the air conduits 67 and 69 suspended from suspension assembly 71 of boom 27 in spanning the space between the self propelled pipe blast cleaner 18 and equipment on vehicle 24. The suspension assembly 71 also supports umbilical power line and control line cable 72 extended from vehicle 24 and connected to the pipe blast cleaner 18 via an operator's control panel 73 mounted on the machine operator platform 74 that includes a seat 75 and safety railing 76 in order that an operator may safely ride the cleaner 18. The operator manually exercises control via the controls of the control panel 73 for drive speed control, elevator drive and speed control, airless blast wheel motor control, and even control of auxillary equipment on vehicle 25 such as the dust collector air flow drive and and the motor of the power generator system.

Referring also to FIGS. 7, 8 and 9, the blast cabinet enclosure 28 is equipped with front and rear seal assemblies 77 and 78 interconnecting the inner rim of blast cabinet enclosure 28 front and rear pipe 10 accomodating openings 79 and 80 and the outer surface of pipe 10. This not only is a barrier to loss of shot and/or grit from the enclosure 28 around the pipe 10 but also enables operation of the enclosure 28 and the whole shot and/or grit handling system at a pressure less than atmosphere. This is accomplished with air flow through conduit 69 being under suction and return flow through conduit 67 being metered via valve control. This results in some vacuum being drawn in shot and/or grit resevoir chamber 47, in the dual elevator structure 48 and through tubes 52, connected through blast cabinet enclosure bottom openings 81 and 82, a vacuum in chamber 47. Each of the front and rear seal assemblies 77 and 78 include three identical seals 83 each of which are assembled of two pieces of overlapping arc seal elements 84 made of flexible rubber or like material. The three seals 83 in the seal assemblies 77 and 78 are mounted in seal retaining grooves 85, 86 and 87 in a conventional manner by bonding agent (or by bolts) (detail not shown) and extend inwardly to an opening diameter a little less than the outer diameter of the pipe 10 to provide therewith a sealing action while the pipe blast cleaner 18 is in operation advancing along the pipe 10. Seal retaining grooves 85, 86 and 87 are provided in seal housing members 88 that each have an annular mounting flange 89 and with a washer like mounting disc 90 are each mounted by bolts 91, respectively, to the front and rear of the blast cabinet enclosure 28. A chamber 92 is formed in each of the seal assemblies 77 and 78 with an opening 93 at the bottom for feeding of shot and/or grit to a return chamber 94 in communication with the interior of the blast cabinet enclosure 28 through bottom wall openings 95 to facilitate return of shot getting by the innermost seal 83 to chamber 92 in the seal assemblies 77 and 78. It should be noted that housing members 88 along with washer like mounting discs 90 are each in two half units that along with seals 83 being made up of two overlapping arcuate seal elements 84 permit partial disassembly for removal of the pipe blast cleaner 18 from pipe 10 or placement on a pipe. The bottom portion 96 of the blast cabinet enclosure 28 is also removable along disassemble removal of tubes 52 and disconnect of couplings 64 for removal of interconnect drive shaft 65 in order that the pipe blast cleaner 18 be removed from pipe 10 or mounted on a pipe 10 for the pipe cleaning operation. The bottom portion 96 of the blast cabinet enclosure 28 is removably fastened in place by fastening devices 97 and seal strips 98 seal the enclosure 28 from air leakage when portion 96 is fastened in place as part of the cabinet enclosure 28.

It is important particularly with an operator riding and controlling the machine as it is advanced along a pipe 10 during its shot and/or grit pipe cleaning operation that the machine be safe and stable in advancing along a pipe 10 and while negotiating turns in pipe 10. In view thereof it is important that the center of gravity 99 of the overall machine including the weight of the operator riding on platform 74 be located well below the center axis 100 of pipe 10. If necessary that the center of gravity be lowered weight elements (not shown) may be added to the bottoms of elevator cabinets 53L and 53R and/or in the areas of the shafts 63 and 65 care being exercised to insure proper machine balance with respect to positioning of the center of gravity 99 which should be on the vertical center line of the machine 18 and pipe 10. It is important from a safety standpoint that no more than one person ride the machine at any one time.

The pipeline industry openly gives recognition that a shot and/or grit blasted outer pipe surface is the most accepted surface finishing for the various coatings and wrappings applied today. This type of surface achieves the required cleaning and, quite importantly, a surface state greatly enhancing adhesion of coatings and wrappings to yield longer pipeline project life. Obviously, since costs of pipeline projects run millions to billions of dollars anything that increases efficiency and service life along with reducing project costs such as attained with the pipe blast cleaner 18 is of great importance.

The cleaning process provided by the pipe blast cleaner 18 is achieved by multiple airless blast wheels 44 powered by electric motors 45 propelling steel shot and/or abrasive grit to impinge on the outside circumferential surface of a pipe 10. The steel shot abrasive is subject to control as by a variable flow control valve and directed by either selected or adjustable components for high efficiency cleaning (some detail not shown). The blast cabinet enclosure 28 with its lining configuration houses the airless blast wheels 44, contains the thrown abrasive (shot or grit) and redirects the abrasive via gravity to the reclaim system that includes two elevators 53L and 53R with belt and bucket elevator belts 55. The elevators pick up the steel abrasive, rust and other entrained contamination lifting it to the top head section where the contents are dump thrown into an airwash gravity type separator system. This results in only reuseable abrasive being retained for recycling from the resevoir through flow pipes including and flow control valves therewith to return to the blasting wheels 44 for blasting surface cleaning reuse. The rubber seal arrangement on each end of the blast cabinet retains rebounding steel abrasive then returned to the recycling system. The machine rolls on the pipe with hour glass rollers some driven for advancing the machine on the pipe 10 with an infinitely variable speed drive propelling the unit.

It should be noted that a smaller unit could be provided with fewer airless blast wheels such as three or four in place of six in the embodiment shown. Further, units could be made where the operator would ride on vehicle 24 with controls provided there instead of there being an operators platform and controls on the machine itself. Such a small self propelled blast pipe cleaning machine would be especially usedful for relatively small diameter pipe.

Whereas this invention has been described with respect to a single embodiment thereof, it should be realized that various changes may be made without departing from the essential contributions to the art made by the teachings hereof.

I claim:

1. A self propelled pipe blast cleaner capable of travel along a pipeline supported over a ditch comprising: a self propelled cart with support rollers for movement along the top of the pipe of the pipeline being blast cleaned; variable speed drive means on said cart for driving said cart along the pipe including rollers of said support rollers; a blast cabinet mounted on said cart and surrounding said pipe for blast cleaning work along said pipe; a plurality of airless abrasive material particle blast wheels contained within said blast cabinet for abrasive material particle blast cleaning of the outer surface of said pipe as said cart is propelled along said pipe; and a blast abrasive material particle reclaiming and circulation system including a reservoir for feeding abrasive material particles to the airless blast wheels; wherein said blast cabinet surrounding the pipe has front and rear openings for passage of the pipe therethrough; wherein a first seal structure including a first seal housing is provided at said front opening and a second seal structure including a second seal housing is provided at said rear opening in said blast cabinet; said seal structures bridging on opening gap between the cabinet and the outer surface of the pipe, respectively, at each of said front and rear openings; said reclaiming and circulation system including abrasive material particle elevator means with elevator housing means mounted on said cart and extending generally from the lowermost extent of the self propelled pipe blast cleaner to the top thereof; piping passage means extending from the bottom of said blast cabinet downwardly to the bottom of said elevator housing means for passage of abrasive material particles that fall to the bottom of the blast cabinet to the bottom of said elevator housing means; said reservoir being mounted below the top of said elevator means and in communication with said elevator means for delivery of abrasive particles lifted by said elevator means to said reservoir means; and a feed line means from said reservoir means to each of said airless abrasive material particle blast wheels for gravity feeding of blast abrasive material particles to each of said airless blast wheels; said reservoir means being a reservoir cabinet mounted above the level of the uppermost airless blast wheel; said feed line means including a plurality of gravity flow feed lines, one line extended to each airless blast wheel from the bottom of said reservoir cabinet; an air wash gravity type separator in the upper portion of said reservoir cabinet with air flow inlet means and air suction outlet means; said blast abrasive material particle reclaiming and circulation system being a substantially sealed system including said blast cabinet so that said air suction outlet means draws a vacuum lowering the pressure below atmospheric pressure within the particle reclaiming and circulation system in addition to drawing air input from said air flow inlet means for the air wash gravity type separator; and wherein said abrasive material particle elevator means includes two opposite side vertical elevators each with a housing enclosing a bottom driven belt and belt mounted cup type elevator.

2. The self propelled pipe blast cleaner of claim 1, wherein said front and rear openings in said blast cabinet are round openings with a clearance allowance from the pipe outer surface adequate for the blast cabinet openings to accomodate passage of the blast cabinet through curves in the pipe with movement of said blast cleaner along the pipeline.

3. The self propelled pipe blast cleaner of claim 1, wherein each of said first and second seal structures include resiliently pliable material seal elements resiliently engaging the outer surface of the pipe sealing the openings from the passage of air to the blast cabinet interior and minimizing the loss of abrasive material particles being used in blast cleaning the outer surface of the pipe.

4. The self propelled pipe blast cleaner of claim 3, wherein each of said first and second seal structures includes a plurality of seal sections in longitudinally spaced relation.

5. The self propelled pipe blast cleaner of claim 4, wherein a chamber is formed in each of said first and second seal structures between the innermost and the next outer seal sections of said plurality of seal structures in each of said first and second seal structures; and gravity feed means for returning abrasive material particles to the interior of the blast cabinet that have gotten by the innermost seal section of each of said first and second seal structures.

6. The self propelled pipe blast cleaner of claim 5, wherein each of said plurality of seal sections are two generally flat arc shaped seal elements mounted in overlapping contiguous relation in respective seal element mounting grooves in the seal housings that are a part of each of said first and second seal structures.

7. The self propelled pipe blast cleaner of claim 1, wherein each of the two opposite side vertical elevators have transversely spaced elevator housings interconnected at the top by the air wash gravity type separator and reservoir cabinet; and extend down to the lowermost extent of the self propelled pipe blast cleaner clearing the opposite sides of the pipe being cleaned; and a single motor drive system for said two opposite side vertical elevators, with motor drive means mounted to the outer side of one of said two opposite side vertical elevators with drive shaft means extending through the bottom portion of both elevator housings and spanning the space between said housings.

8. The self propelled pipe blast cleaner of claim 7, wherein said drive shaft means includes shaft couplings adjacent to and inside of both elevator housings to facilitate removal of a shaft section as required for placement of the pipe cleaner machine on a pipe and for removal therefrom.

9. The self propelled pipe blast cleaner of claim 8, wherein said piping passage means extending from the bottom of said blast cabinet is in the form of two pipes extending, respectively, from the bottom of said blast cabinet downwardly to the bottom of each of said opposite side elevator housings.

10. The self propelled pipe blast cleaner of claim 9, wherein said blast cabinet includes a bottom portion removably fastened in place by fastening means provided therefor; and seal strip means sealing the blast cabinet enclosure from air leakage when the bottom portion is fastened in place.

11. The self propelled pipe blast cleaner of claim 10, wherein said first and second seal structures are each separable with an upper half and a lower half for disassembly and removal of the bottom halves along with the bottom portion of the blast cabinet to facilitate placement of the pipe cleaner on a pipe and for removal therefrom.

12. The self propelled pipe blast cleaner of claim 11, with the pipe blast cleaner constructed for placement of the center of gravity below rolling contact of said rollers on the top of the pipe being blast cleaned.

13. The self propelled pipe blast cleaner of claim 11, with the pipe blast cleaner constructed for placement of the center of gravity below the longitudinal center of the pipe as it is being cleaned by said pipe blast cleaner.

14. The self propelled pipe blast cleaner of claim 11, wherein said rollers are hour glass shaped rollers.

15. The self propelled pipe blast cleaner of claim 14, wherein said rollers are made of a relatively hard resilient rubber like material.

16. The self propelled pipe blast cleaner of claim 13, wherein an operators station is provided on said self propelled cart; and machine controls are provided at said operators station.

17. The self propelled pipe blast cleaner of claim 13, wherein umbilical connections are provided to said self propelled cart for air line connections to filter and air suction means remote from said cart; and power connections from a remote source to said cart.

18. The self propelled pipe blast cleaner of claim 7, wherein said elevator belts in each opposite side vertical elevator are twisted ninety degrees between the bottom drive pulleys and the top idler pulleys to facilitate discharge from the cups thereon inwardly to the abrasive material particle reservoir.

19. The self propelled pipe blast cleaner of claim 18, wherein the elevator belt system in each opposite side vertical elevator is a dual belt elevator driven by dual driving pulleys at the bottom and running over dual idler pulleys at the top.

20. The self propelled pipe blast cleaner of claim 19, wherein removable contamination sampling tray means is provided in said reservoir.

* * * * *